United States Patent [19]

Nomura et al.

[11] 4,324,480

[45] Apr. 13, 1982

[54] AUTOMATIC FILM FEEDER FOR AN AUTOMATIC DEVELOPER

[75] Inventors: Norimasa Nomura, Mori; Atsushi Yoshida, Kyoto, both of Japan

[73] Assignee: Dainippon Screen Seizo Kabushiki Kaisha, Kyoto, Japan

[21] Appl. No.: 235,423

[22] Filed: Feb. 17, 1981

[30] Foreign Application Priority Data

Feb. 27, 1980 [JP] Japan ..... 55/23676

[51] Int. Cl.[3] ..... G03D 3/12

[52] U.S. Cl. ..... 354/320; 271/9

[58] Field of Search ..... 354/319, 320, 322, 339; 271/9; 355/27, 100

[56] References Cited

U.S. PATENT DOCUMENTS

| | | | |
|---|---|---|---|
| 3,720,408 | 3/1973 | Horn | 354/319 |
| 3,879,030 | 4/1975 | Hommerin | 354/319 |
| 3,891,854 | 6/1975 | Hura | 354/339 |

*Primary Examiner*—L. T. Hix
*Assistant Examiner*—Alan Mathews
*Attorney, Agent, or Firm*—Zarley, McKee, Thomte, Voorhees & Sease

[57] ABSTRACT

An automatic film feeder for an automatic developer wherein films exposed are processed through a developing tank, and wherein the films put in trays arranged above an endless belt which feeds the films into the developer, are ejected from the trays onto the belt by film ejectors of the same number as the trays, a control means controlling the ejectors so that the films may be ejected in the desired order and may be fed to the developer one by one without overlapping one on another.

11 Claims, 4 Drawing Figures

AUTOMATIC FILM FEEDER FOR AN AUTOMATIC DEVELOPER

BACKGROUND OF THE INVENTION

The present invention relates to an automatic film feeder for an automatic developer.

In a photographic plate-making or other photographic operations, a photosensitive film exposed is successively passed through a developing tank, a fixing tank, a washing tank, and a drying tank of an automatic developer, thereby completing a developing process of the film automatically. Such an automatic developer which is capable of saving the operations very much in a darkroom, has been used broadly.

However, this kind of automatic developer still involves a manual operation therein. For example, in most of automatic developers now realized the film exposed is fed manually one by one to a conveyer means of the developer. In this case, the transfer speed of the film depends on the developing time and the transfer length in the developing solution, and usually it is a low speed such as between several and scores of milimeter per second.

When only one film is processed, after feeding the film into the conveyer means the film is transferred automatically and thus all is well. However, in practice, at least several films exposed are consecutively processed in the developer. Especially, when one automatic developer is used in common for a plurality of exposure means such as process camera, a plurality of films exposed must be fed manually one by one to the developer.

The automatic developer cannot process more than two films in parallel at the same time except that the two films of small size are fed in parallel. That is, after one film is completely passed through the start point of the transfer conveyer, the following film is fed to the conveyer.

However, since the film transfer speed is rather slow as described above, it takes fairly long time to feed the film completely into the conveyer. When the film photographing in the plate making operation is carried out, generally, the reproduction picture having the same size as required to the final printed matter is photographed. A photosensitive film having a relatively long size such as more than 25 centimeter is often used, and accordingly in almost all cases it takes more than ten seconds to feed the film completely into the conveyer. This time means only a stand-by time for the operator, which is rather waste of time. Further, this developing operation should be performed in the darkroom, and thus it is not good for health.

In a conventional developer for processing a X-ray film exposed, an automatic feeder which insert the film having a certain size stacked one on another has been developed. However, in the plate making the films of different sizes are processed and hence this kind of automatic feeder cannot be utilized.

SUMMARY OF THE INVENTION

Therefore, it is an object of the present invention to provide an automatic film feeder for an automatic developer free from the above described inconveniences, which has a simple construction, and which is capable of saving the standby time very much and adjusting the feeding order of the films to be processed.

According to this invention there is provided an automatic film feeder for an automatic developer wherein a film exposed is processed through a developing tank, comprising (a) an endless belt for transferring a film to a developer, (b) a plurality of trays which are arranged above the belt and each of which contains one film, (c) film ejectors of the same number as the trays, each ejecting the film from the corresponding tray onto the belt, and (d) a control means which controls the ejectors so that the films may be ejected from the trays in the desired order and may be fed to the developer one by one without overlapping one on another.

BRIEF DESCRIPTION OF DRAWINGS

In order that the present invention may be better understood preferred embodiments thereof will be described with reference to the accompanying drawings, in which.

DESCRIPTION OF PREFERRED EMBODIMENTS

Figure 1:
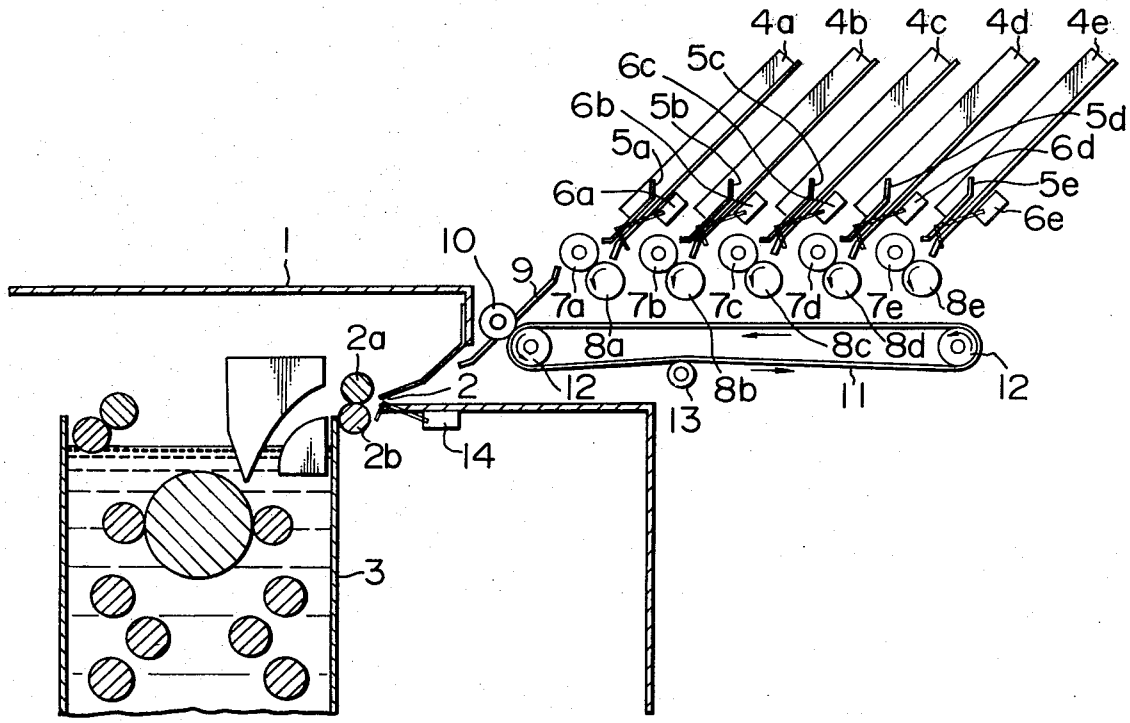
FIG. 1 is a longitudinal cross-sectional side view of one embodiment of an automatic film feeder for an automatic developer according to the present invention.

Referring now to the drawings there is shown one embodiment of an automatic film feeder for an automatic developer according to the present invention.

An automatic developer 1 is provided with a film entrance 2 and feed rollers 2*a* and 2*b* nearby in the upper portion. A photosensitive film (not shown) exposed is to be fed to a developing tank 3 of the developer 1 through the film entrance 2 and the feed rollers 2*a* and 2*b*.

A plurality of film container trays 4*a*, 4*b*, 4*c*, 4*d* and 4*e* are arranged, in parallel, in the rear upper portion of the developer 1, and are arranged aslope by inclining their tops rearwards so that the films to be processed may slide down over the slide surfaces of the trays 4*a*–4*e*. A guide member 5*a*, 5*b*, 5*c*, 5*d* or 5*e* is mounted to the lower part of each tray 4*a*, 4*b*, 4*c*, 4*d* or 4*e* in parallel with the slide surface thereof.

A micro switch 6*a*, 6*b*, 6*c*, 6*d* or 6*e* having an actuating lever is mounted on the lower part of the opposite surface to the slide surface of the tray 4*a*, 4*b*, 4*c*, 4*d* or 4*e*, and each actuating lever of the micro switch projects to the space between the guide member 5*a*, 5*b*, 5*c*, 5*d* or 5*e* and the slide surface of the tray 4*a*, 4*b*, 4*c*, 4*d* or 4*e* through a slit cut on the tray so as to interfere the passage between the guide member and the slide surface of the tray. However, the actuating lever of the micro switch is adapted to be lowered by the weight of the film passing through the passage between the guide member and the slide surface of the tray, and, when the actuating lever is lowered or rises, the micro switch outputs an ON or OFF signal which is sent to a control circuit shown in FIG. 2.

A pair of push roller 7*a*, 7*b*, 7*c*, 7*d* or 7*e* and feed roller 8*a*, 8*b*, 8*c*, 8*d* or 8*e*, the former contacting with the latter by its own weight, are arranged under the corresponding tray 4*a*, 4*b*, 4*c*, 4*d* or 4*e* so as to receive and to forward the film fed from the tray.

The feed rollers 8a–8e are coupled to a motor or motors (not shown) via shafts, clutches, sprockets and pulleys (not shown), and thus are selectively driven by actuating the clutches in directions as indicated by arrows in FIG. 1. The peripheral speeds of the feed rollers 8a–8e are controlled to be the same as that of the feed rollers 2a and 2b of the developer 1.

A guide member 9 and a guide roller 10 positioned near its central portion are arranged in the front lower part of the feed roller 8a. An endless belt 11 suspended horizontally by pulleys 12 is positioned in contact with the guide roller 10 under the push rollers 7a–7e and the feed rollers 8a–8e, and is driven by a motor (not shown) in directions as indicated by arrows. The belt 11 is adapted to be driven at the same speed as the peripheral speed of the feed rollers 2a and 2b. The tension of the belt 11 is controlled by a tension roller 13 which pushes the lower path part of the belt 11. The guide roller 10 pushes the front end of the belt 11 by its own weight. A micro switch 14 having an actuating lever may be arranged near the feed rollers 2a and 2b so that the actuating lever may normally interfere the film entrance 2, and may readily be lowered by the film passing therethrough. When the actuating lever is lowered or moves up, the micro switch 14 may output an ON or OFF signal.

Figure 2:
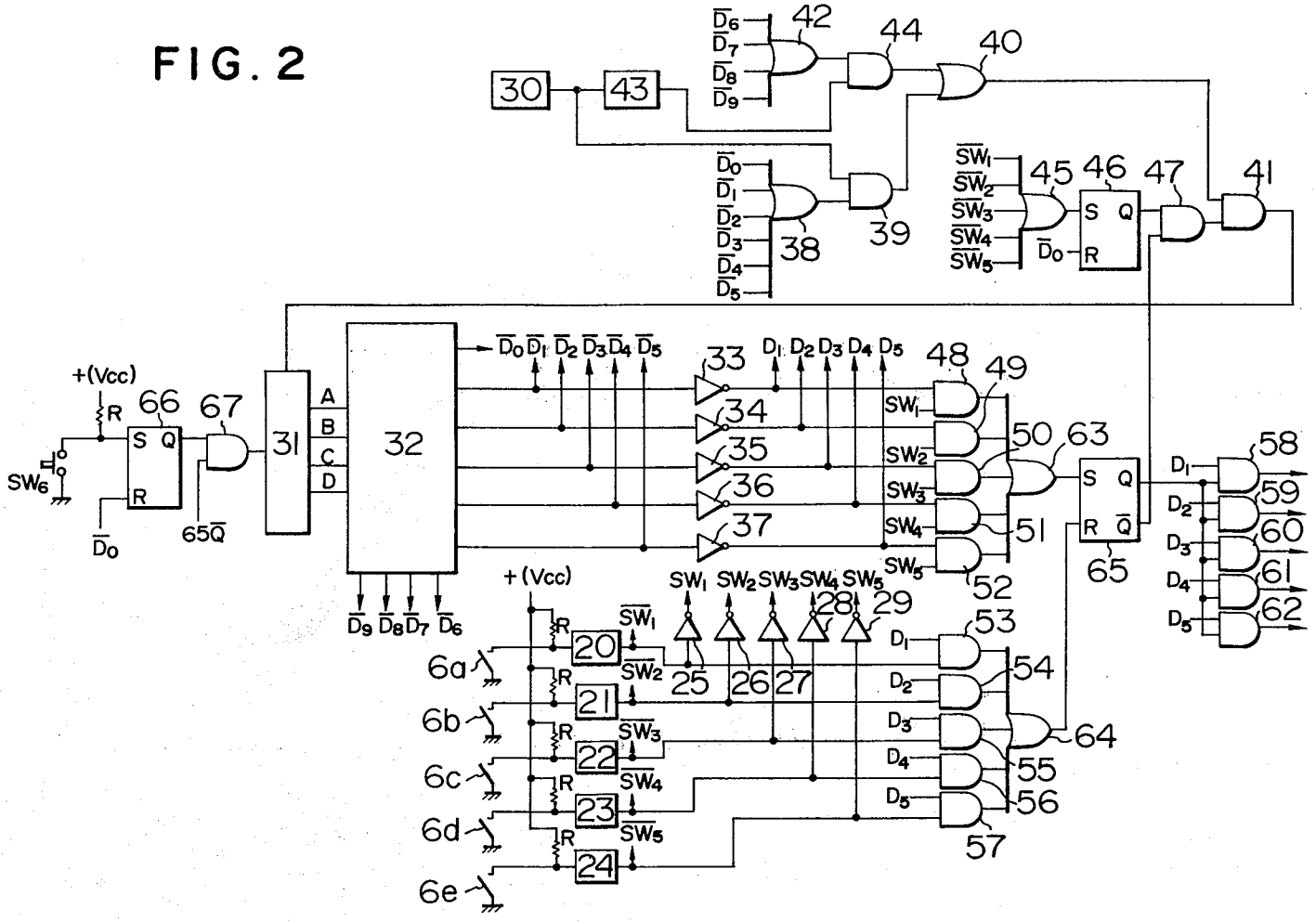
FIG. 2 is a control circuit for operating the automatic film feeder of FIG. 1.

In FIG. 2 there is shown a control circuit for feeding the films exposed consecutively into the automatic developer 1 by using the automatic film feeder shown in FIG. 1.

Figure 3:
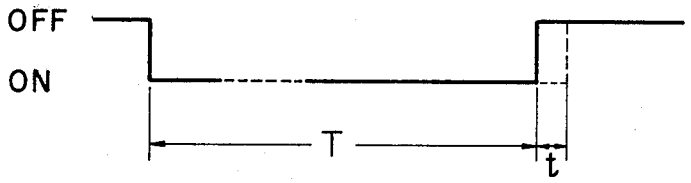
FIG. 3 is a time chart of an input signal which is to be sent to the control circuit of FIG. 2.

One terminals of the micro switches 6a–6e are connected to the ground, and the other terminals of the same are connected to an electric source Vcc via resisters R and to input terminals of timers 20–24 which delay a time T of an input signal shown in FIG. 3 a time t. The time T means, for example, a period from the time the micro switch 6a is turned from OFF to ON when the film is fed to the tray 4a of FIG. 1 and pushes down the actuating lever of the micro switch 6a, as shown in FIG. 3, to the time the micro switch 6a is turned from ON to OFF when the film fed to the tray 4a is ejected therefrom by driving the feed roller 8a by actuating the clutch and the actuating lever of the micro switch 6a is released from being pushed by the film.

If the clutch is released as soon as the micro switch 6a is turned from ON to OFF, the rear end of the film is still catched by the push roller 7a and the feed roller 8a. Accordingly, after the micro switch 6a is turned to OFF, the release of the clutch must be delayed by the time t while the film is completely passed apart the rollers 7a and 8a.

When it is displayed by a lamp or a luminescent semiconductor diode whether the film is put in the tray 4a or not, the output signal generated by the micro switch 6a is not directly used because, when the lamp or the diode is switched on as soon as the micro switch 6a is turnd from ON to OFF, the rear end of the film is still catched by the rollers 7a and 8a, and, on this occasion, when one more film is fed to the tray 4a, the two films may be sent to the developer 1 at the same time. Therefore, the display time of the lamp or the diode must be delayed by the time t. The time may be dalayed by using an electronic circuit including a semiconductor element, such as one-shot multivibrator or a timer, or a mechanical delay relay.

The timers 20–24 output signals $\overline{SW}_1$–$\overline{SW}_5$ which are inverted in inverters 25–29 to obtain signals $\overline{SW}_1$–$\overline{SW}_5$. The signals $\overline{SW}_1$–$\overline{SW}_5$ are normally at the high level, and when the switches 6a–6e are turned on, the signals $\overline{SW}_1$–$\overline{SW}_5$ become low.

A pulse generator 30 generates a clock pulse for operating stepwise a base-10 counter 31 which outputs a binary coded signal. Then, a decoder 32 converts the binary coded signal into one of decimal coded signals $\overline{D}_0$, $\overline{D}_1$, $\overline{D}_2$, $\overline{D}_3$, $\overline{D}_4$, $\overline{D}_5$, $\overline{D}_6$, $\overline{D}_7$, $\overline{D}_8$ and $\overline{D}_9$ which are at the low level. The signals $\overline{D}_1$–$\overline{D}_5$ are inverted in inverters 33–37 to obtain corresponding decimal coded signals $D_1$–$D_5$ which are at the high level.

When one of the signals $\overline{D}_0$–$\overline{D}_5$ is input to an OR gate 38, it outputs a signal which is to be sent to one input terminal of an AND gate 39. The other input terminal of the AND gate 39 is connected to the output terminal of the pulse generator 30. The output terminal of the AND gate 39 is connected to one input terminal of an OR gate 40, and the other input terminal of the OR gate 40 is linked to the output terminal of an AND gate 44. The output terminal of the OR gate 40 is connected to one input terminal of an AND gate 41.

When one of the signals $\overline{D}_6$–$\overline{D}_9$ is fed to an OR gate 42, it outputs a signal to one input terminal of the AND gate 44. A frequency divider 43 divides the frequency of the clock pulse sent from the pulse generator 30 into about 0.1 pulse per second and the output terminal of the frequency divider 43 is linked to the other input terminal of the AND gate 44.

When one of the signals $\overline{SW}_1$–$\overline{SW}_5$ is sent to an OR gate 45, it outputs a signal to an input terminal S of a flip-flop circuit 46. The signal $\overline{D}_0$ generated by the decoder 32 is fed to a reset terminal R of the flip-flop circuit 46. The output terminal Q of the flip-flop circuit 46 is coupled to one input terminal of an AND gate 47. The output terminal of the AND gate 47 is connected to the other input terminal of the AND gate 41. The output terminal of the AND gate 41 is linked to an input terminal of the counter 31.

To two input terminals of AND gates 48–52, the signals $D_1$ and $SW_1$; $D_2$ and $SW_2$; $D_3$ and $SW_3$; $D_4$ and $SW_4$; $D_5$ and $SW_5$ are fed. The output terminals of the AND gate 48–52 are connected to input terminals of an OR gate 63. The output terminal of the OR gate 63 is linked to an input terminal S of a flip-flop circuit 65.

To two input terminals of AND gates 53–57, the signals $D_1$ and $\overline{SW}_1$; $D_2$ and $\overline{SW}_2$; $D_3$ and $\overline{SW}_3$; $D_4$ and $\overline{SW}_4$; and $D_5$ and $\overline{SW}_5$ are input. The output terminals of the AND gates 53–57 are linked to input terminals of an OR gate 64. The output terminals of the OR gate 64 is connected to a reset terminal R of the flip-flop circuit 65.

One output terminal Q of the flip-flop circuit 65 is linked to one input terminals of AND gates 58–62, and the other output terminal $\overline{Q}$ of the flip-flop circuit 65 is connected to the other input terminal of the AND gate 47. To the other input terminals of the AND gates 58–62, the signals $D_1$–$D_5$ are fed, and the AND gates 58–62 output signals for actuating the clutches (not shown) which couple the feed rollers 8a–8e to the drive motor or motors (not shown) in order to drive the feed rollers 8a–8e.

The control circuit of FIG. 2 may be provided with a preference switch $SW_6$. One terminal of the preference switch $SW_6$ is connected to the ground and the other terminal of the same is linked to the power source Vcc via a resister R and to an input terminal S of a flip-flop circuit 66. To an reset terminal R of the flip-flop circuit 66 is fed the signal $\overline{D}_0$. The output terminal Q of the flip-flop circuit 66 is linked to one input terminal of an AND gate 67, and to the other input terminal of the AND gate 67 is input a delayed signal 65$\overline{Q}$ which is obtained by delaying the signal output from the terminal $\overline{Q}$ of the flip-flop circuit 65 by means of a timer (not shown). This delay of the signal is carried out so as to prevent the two films from being fed to the developer 1 in the same time, as described above. The output terminal of the AND gate 67 is connected to the counter 31.

The operation of the control circuit shown in FIG. 2 will be described as follows.

The electric source is switched on, an then, the counter 31 and the flip-flop circuit 65 are reset by an initiator circuit (not shown). A binary coded signal A(0), B(0), C(0), D(0), i.e. 0000, wherein A is the lowermost bit and D is the uppermost bit, hereinafter described in the same manner, is output from the counter 31, and the decoder 32 outputs the signal $D_0$. The output signal of the terminal Q of the flip-flop circuit 65 is at the low level. Therefore, no clutch actuating signal is output from the AND gates 58–62.

When no film is contained in the trays 4*a*–4*e*, the micro switches 6*a*–6*e* are all off. Accordingly, the OR gate 45 is closed, and the output signal of the terminal Q of the flip-flop circuit 46 is maintained at the low level. Hence, the one input terminal of the AND gate 47 is at the low level, but the other input terminal of the same is at the high level, and thus the output terminal of the AND gate 47 is at the low level. That is, since the other input terminal of the AND gate 41 is at the low level, no pulse is input to the counter 31, and hence the counter 31 is maintained to be still in the reset state.

Then, when the films exposed are fed to the trays 4*a*, 4*c* and 4*d*, the micro switches 6*a*, 6*c* and 6*d* are switched on, and thereby the signals $\overline{SW_1}$, $\overline{SW_3}$ and $\overline{SW_4}$ output from the timers 20, 22 and 23 are changed from the high level to the low level. These signals $\overline{SW_1}$, $\overline{SW_3}$ and $\overline{SW_4}$ are fed to the OR gate 45, and then the OR gate 45 outputs the signal to the flip-flop circuit 46, resulting in setting of the flip-flop circuit 46. Now, the output signal at the output terminal Q of the flip-flop circuit 46 becomes high, that is, both the input terminals of the AND gate 47 are at the high level, and thus the AND gate 47 outputs the high level signal. Accordingly, the other input terminal of the AND gate 41 is at the high level.

On the other hand, the decoder outputs the signal $D_0$ and the OR gate 38 outputs the high level signal to open the AND gate 39. Hence, the clock pulse generated by the pulse generator 30 is sent to the counter 31 through the AND gate 39, the OR gate 40 and the AND gate 41, and the counter 31 counts one step. Then, the counter 31 outputs a binary code A(1), B(0), C(0), D(0), and the decoder 32 outputs the signal $\overline{D_1}$.

Then, the signals $D_1$ and $SW_1$ fed to the AND gate 48 become at the high level, and the AND gate 48 outputs the signal to the input terminal S of the flip-flop circuit 65 via the OR gate 63 to set the flip-flop circuit 65. Thus, the output terminals Q and $\overline{Q}$ are at the high level and at the low level, respectively.

Now, the two input terminals of the AND gate 58 are at the high level, and the AND gate 58 outputs a clutch actuating signal for driving the feed roller 8*a*. Meanwhile, the other input terminal of the AND gate 47 is at the low level, and the AND gate 41 is closed. Hence, it does not pass the clock pulse to the counter 31. Then, the feed roller 8*a* is driven by actuating the clutch, and the film is ejected from the tray 4*a* onto the belt 11 by the push roller 7*a* and the feed roller 8*a*. Then the film is passed between the guide roller 10 and the belt 11 along the guide member 9 and then is fed to the entrance 2 of the developer 1.

When the film is completely passed through the rollers 7*a* and 8*a*, the micro switch 6*a* is turned off, and the signal $SW_1$ is changed from the low level to the high level. Now, the high level signals $D_1$ and $\overline{SW_1}$ are fed to the two input terminals of the AND gate 53, and the AND gate 53 sends an output signal to the reset terminal R of the flip-flop circuit 65 via the OR gate 64. Thus, the flip-flop circuit 65 outputs the low level signal at its terminal Q and the high level signal at its terminal $\overline{Q}$. Therefore, the AND gate 58 stops the clutch actuating signal for driving the feed roller 8*a*, and the roller 8*a* is stopped.

On the other hand, the flip-flop circuit 65 sends the high level signal to the other terminal of the AND gate 47. Then, the AND gate 47 outputs the high level signal to the other terminal of the AND gate 41 to open it so that the clock pulse generated by the pulse generator 30 may be sent to the counter 31 through the AND gate 41. Then, the counter 31 counts one step and outputs a binary code A(0), B(1), C(0), D(0) and the decoder 32 outputs the signal $\overline{D_2}$.

Then, since no film is put in the tray 4*b*, the signal $\overline{SW_2}$ fed to the AND gate 49 is at the low level, and thus the AND gate 49 does not output any signal. Hence, the flip-flop circuit 65 is still maintained in the previous condition, and the AND gate 59 does not output a clutch actuating signal for driving the feed roller 8*b*.

On this occasion, the AND gate 41 is kept to be open, and hence the clock pulse generated by the pulse generator 30 is input to the counter 31. Then, the counter 31 counts one step and outputs a binary code A(1), B(1), C(0), D(0), and the decoder 32 outputs the signal $\overline{D_3}$.

Next, since the film is contained in the tray 4*c*, the signal $SW_3$ at the high level is sent to the AND gate 50, and the AND gate 50 outputs the signal to the flip-flop circuit 65 through the OR gate 63 to set the flip-flop circuit 65. The flip-flop circuit 65 outputs the high level signal at its terminal Q and the low level signal at its terminal $\overline{Q}$. Then, the AND gate 60 outputs a clutch actuating signal for driving the feed roller 8*c*, and the AND gate 47 does not output the high level signal to the AND gate 41, with the result that the AND gate 41 is closed.

The film in the tray 4*c* is transferred to the developer 1 by the rollers 7*c* and 8*c* in the same manner as described above. When the film is passed through the rollers 7*c* and 8*c*, the micro switch 6*c* is turned off. The signal $SW_3$ is changed from the high level to the low level, and the signal $\overline{SW_3}$ is changed from the low level to the high level. Therefore, the AND gate 50 does not output any signal and the AND gate 55 outputs a signal to the reset terminal R of the flip-flop circuit 65 via the OR gate 64 to reset the flip-flop circuit 65.

Then, the flip-flop circuit 65 outputs the low level signal at its terminal Q and the high level signal at its terminal $\overline{Q}$. Hence, the AND gate 60 stops the clutch actuating signal for driving the feed roller 8*c*, and the roller 8*c* is stopped. Meanwhile, the AND gates 47 and 41 are opened so that the clock pulse generated by the pulse generator 30 may be fed to the counter 31. Then, the counter 31 counts one step and outputs a binary code A(0), B(0), C(1), D(0), and the decoder 32 outputs the signal $\overline{D_4}$.

Then, since the film is contained in the tray 4*d*, the micro switch 6*d* is turned on, and the signal $SW_4$ is at the high level. Accordingly, the AND gate 51 outputs a signal to the flip-flop circuit 65 through the OR gate 63 to set the flip-flop circuit 65, and the flip-flop circuit 65 outputs the high level signal at its terminal Q and the low level signal at its terminal $\overline{Q}$. The AND gate 61 outputs a clutch actuating signal for driving the feed roller 8*d*, and the AND gate 41 is closed.

When the rollers 7*d* and 8*d* eject the film from the tray 4*d*, the signal $SW_4$ is changed from the high level to the low level and the signal $\overline{SW}_4$ is changed from the low level to the high level. Hence, the AND gate 51 does not output a signal and the AND gate 56 outputs a signal to the reset terminal R of the flip-flop circuit 65 via the OR gate 64 to reset it.

Now, the flip-flop circuit 65 outputs the low level signal at the terminal Q and the high level signal at the terminal $\overline{Q}$. Then, the AND gate 61 stops the clutch actuating signal for driving the feed roller 8*d*, and the rollers 7*d* and 8*d* are stopped. Meanwhile, the AND gates 47 and 41 are opened so that the clock pulse generated by the pulse generator 30 may be fed to the counter 31. Then, the counter 31 counts one step and outputs a binary code A(1), B(0), C(1), D(0), and the decoder 32 outputs the signal $\overline{D}_5$.

Then, since the no film is put in the tray 4*e*, the signal $SW_5$ is at the low level, and the AND gate 52 does not output a signal. Accordingly, the flip-flop circuit 65 is still maintained in the previous condition, and the AND gate 62 does not output a clutch actuating signal for driving the feed roller 8*e*.

On this occasion, the AND gate 41 is maintained to the open state, and accordingly the clock pulse generated by the pulse generator 31 is fed to the counter 31. Then, the counter 31 counts one step and outputs a binary code A(0), B(1), C(1), D(0), and the decoder 32 outputs the signal $\overline{D}_6$.

In this embodiment, the five trays 5*a*–5*e* are provided, and thus there is no need to use the signals $\overline{D}_6$–$\overline{D}_9$. However, these signals $\overline{D}_6$–$\overline{D}_9$ may be used for making a stand-by time required to prevent the two films from being fed to the developer 1 in the same time. For example, the stand-by time required depends on the positions of the trays 4*a*–4*e*. After the film is passed through the rollers 7*e* and 8*e*, the stand-by time required is the longest. That is, if as soon as the film in the tray 4*e* is passed through the rollers 7*e* and 8*e*, the film contained in the tray 4*a* is transferred, the film ejected from the tray 4*a* is overlapped in the largest onto the film ejected from the tray 4*e* on the belt 11. Therefore, after the film ejected from the tray 4*e* is transferred at least past the guide roller 10, the film in the tray 4*a* is ejected.

When the decoder 32 outputs the signal $\overline{D}_6$, the OR gate 38 is closed, and it closes the AND gate 39. Then, the OR gate 42 is opened, and it opens the AND gate 44, so that the output signal generated by the frequency divider 43 may be sent to the counter 31 through the OR gate 40 and the AND gate 41.

The terminal Q of the flip-flop circuit 46 is maintained at the high level until it is reset by the signal $\overline{D}_0$ after the film is ejected from the tray, and hence the AND gates 47 and 41 are still open. Accordingly, the counter 31 is moved one step by the output signal generated by the frequency divider 43, and outputs the binary coded signal A(0), B(0), C(0), D(0). Then, the decoder 32 outputs the signal $\overline{D}_0$ which resets the flip-flop circuit 46, thereby closing the AND gates 47 and 41.

Hence, the frequency division rate of the frequency divider 43 is predetermined, so that it may be the longest stand-by time from the time the decoder 32 outputs the signal $\overline{D}_6$ to the time the decoder 32 outputs the signal $\overline{D}_0$, viz., from the time the film is moved off the rollers 7*e* and 8*e* to the time the film is moved off the guide roller 10.

In this embodiment, the stand-by time after the ejection of the film from the tray 4*e* is the longest. When the film is not contained in the tray 4*e*, this longest stand-by time can be reduced by a certain period corresponding to the ejection of the film contained in the tray 4*e*. Although the stand-by time is made by using the counter in this embodiment, however, this is done by utilizing the output signal generated by the micro switch 14 near the feed rollers 2*a* and 2*b*.

When no film is held in the trays 4*a*–4*e* at the moment on which the decoder 32 outputs the signal $\overline{D}_0$, no signal is fed to the counter 31, and the counter 31 does not output a new signal. In such a case, an optical signal or an acoustic signal may be output in order to inform the operation that all the films are transferred. When the films to be processed are contained in the trays 4*a*–4*e*, the films are transferred consecutively to the developer 1, as described above.

The preference switch $SW_6$ shown in FIG. 2 is used as follows. In the operation that the films held in the trays 4*a*–4*e* are successively supplied one by one to the developer 1, assuming that the two films are already fed and the film held in the tray 4*c* is now being transferred to the developer 1, when another film is urgently processed, it is put, for example, in the tray 4*a*, and then it is transferred to the developer 1 after the supply of the film ejected from the tray 4*c*, but prior to the films contained in the trays 4*d* and 4*e*, by pushing the preference switch $SW_6$, or first the preference switch $SW_6$ is pushed and then another film is put in the tray 4*a*.

In this case, when the preference switch $SW_6$ is pushed, the flip-flop circuit 66 is set, and the output signal at its terminal Q goes high. Then, the signal level at the input terminal of the AND gate 67 goes high. However, since the film held in the tray 4*c* is now being fed to the developer 1, the signal level at the terminal $\overline{Q}$ of the flip-flop circuit 65 is low, and hence the delayed signal 65$\overline{Q}$ is at the low level. Accordingly, the AND gate connot reset the counter 31.

Then, when the film is moved off the rollers 7*c* and 8*c*, the flip-flop circuit 65 is inverted, and the signal level at the terminal $\overline{Q}$ goes high. The high level signal at the terminal $\overline{Q}$ is delayed by the timer when the film ejected from the tray 4*c* is moved off the guide roller 10, and the two high level signals are input to the AND gate 67. Then, the AND gate 67 resets the counter 31 and the AND gates 47 and 41 are opened, so that the clock pulse generated by the pulse generator 31 may be sent to the counter 31. Thus, the counter 31 counts one step and outputs the binary coded signal A(1),B(0), C(0),D(0), and the decoder 32 outputs the signal $\overline{D}_1$.

Therefore, the film put in the tray 4*a* is transferred to the developer 1 before the films held in the trays 4*d* and 4*e* are consecutively fed to the developer 1. The preference switch $SW_6$ is very convenient especially for a film feeder including a lot of container trays.

According to the present invention, the preference switch means described above may be used as modified in the followings. For example, a preference switch is provided to each of the trays 4*a*–4*e*. When, while the film in the tray 4*c* is transferred to the developer 1, the film in the tray 4*b* is to be fed in preference to the film in the tray 4*d* is pushed, so that, after the film ejected from the tray 4*c* is fed to the developer 1 and taking the stand-by time, the film in the tray 4b may be fed to the developer 1 prior to the film in the tray 4d or 4e, and then the film feeding may be returned to the normal operation in the same manner as described above.

In this case, when more than the two preference switches are pushed, the order of the pushes of the switches together with the trays' numbers can be memorized in a memory means, and then the films may be processed in the pushing order or in the numerical order.

According to the present invention each tray may be also provided with a lamp which indicates that the film is put in the tray, for preventing the two film from being put therein. When one film is put in each tray, the corresponding lamp is adapted to be switched on by using the signals $SW_1$–$SW_5$ or $\overline{SW}_1$–$\overline{SW}_5$ from the time the film is put in the tray to the time the film is ejected from the tray past the rollers 7a–7e and 8a–8e.

Figure 4:
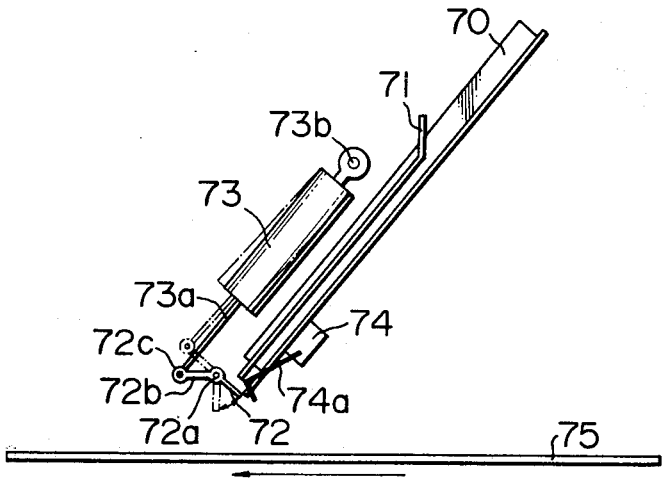
FIG. 4 is a longitudinal cross-sectional side view of another embodiment of another film eject means according to the present invention.

In FIG. 4 there is shown another film eject means of an automatic film feeder according to the present invention. In FIG. 4 only one film eject means is shown for simplicity of the explanation.

A film container tray 70 corresponding to one of the trays 4a–4e of FIG. 1 is inclined in the same manner as the trays 4a–4e. A guide member 71 of a somewhat longer size is mounted to the lower half part of the tray 70 in parallel with the slide surface thereof. A stop lever 72 is pivotally mounted near the bottom of the tray 70 around a pivot shaft 72a and a free end of the stop lever 72 is adapted to close or open the bottom of the tray 70. A link end of an arm 72b of the stop lever 72 is pivotally connected to the lower end of an actuating rod 73a of a plundger 73 around a link shaft 72c. The top of the plundger 73 is pivotally mounted around a pivot shaft 73b.

A micro switch 74 having an actuating lever 74a, which has the same construction and functions as the micro switches 6a–6e, is mounted on the lower part of the opposite surface to the slide surface of the tray 70, and the actuating lever 74a projects to the passage between the guide member 71 and the slide surface of the tray 70 through a slit cut on the tray 70 so as to interfere the passage. The micro switch 74 and the actuating lever 74a function in the same manner as those 6a–6e of FIG. 1. Under the tray 70 an endless belt 75 runs for transferring the film ejected from the tray 70.

When the film to be processed is put in the tray 70, the film pushes down the actuating lever 74a of the micro switch 74 which outputs the ON signal. The ON signal is sent to the control circuit shown in FIG. 2. In this embodiment, instead of actuating the clutch for driving one of the feed rollers 8a–8e shown in FIG. 1, the plunger 73 is actuated in the same manner as described above, thereby opening the bottom of the tray 70 by pivoting the free end of the stop lever 72 away from the bottom of the tray 70. Then, the film in the tray 70 goes down onto the belt 75 by its own weight.

When the film is ejected from the tray 70, the actuating lever 74a of the micro switch 74 is released from being pushed down, and the micro switch 74 outputs the OFF signal. The film is fed to the developer 1 by using the control circuit of FIG. 2 in the same manner as described above. In this embodiment, a vacuum belt of a conventional type may be used instead of the belt 75.

Although the present invention has been described with reference to preferred embodiments thereof, however, various changes and modifications can be made by those skilled in the art without departing from the scope of the present invention.

What is claimed is:

1. An automatic film feeder for an automatic developer wherein a film exposed is processed through a developing tank, comprising:

(a) an endless belt for transferring a film to a developer;

(b) a plurality of trays which are arranged above the belt and each of which contains one film;

(c) film ejectors of the same number as the trays, each ejecting the film from the corresponding tray onto the belt; and (d) a control means which controls the ejectors so that the films may be ejected from the trays in the desired order and may be fed to the developer one by one without overlapping one on another.

2. A film feeder as defined in claim 1, further comprising a preference switch means by which the desired film put in its tray is ejected in preference to the other films put in the other trays except the film which is being ejected when the preference switch is pushed.

3. A film feeder as defined in claim 2, wherein the trays are arranged vertically in parallel one another.

4. A film feeder as defined in claim 2, wherein the trays are somewhat inclined at a certain angle.

5. A film feeder as defined in claim 3 or 4, wherein each film ejector comprises a pair of rollers arranged near the bottom of each tray.

6. A film feeder as defined in claim 3 or 4, wherein each film ejector comprises a stop member which is adapted to open or close the bottom of each tray.

7. A film feeder as defined in claim 5, wherein, when the completion of the ejection of one film put in its tray is detected, the ejection of another film put in its tray is started.

8. A film feeder as defined in claim 6, wherein, when the completion of the ejection of one film put in its tray is detected, the ejection of another film put in its tray is started.

9. A film feeder as defined in claim 6 wherein the ejection of another film put in its tray is started after a certain stand-by time which is taken after one film put in its tray is completely ejected.

10. A film feeder as defined in claim 7, wherein the ejection of another film put in its tray is started after a certain stand-by time which is taken after one film put in its tray is completely ejected.

11. A film feeder as defined in claim 9 or 10 wherein the ejector of the film put in the first tray is started after a certain stand-by time which is taken after the film put in the last tray is completely ejected.

* * * * *